US007607546B1

(12) United States Patent
Hopper

(10) Patent No.: US 7,607,546 B1
(45) Date of Patent: Oct. 27, 2009

(54) HITCH MOUNTED HOIST ASSEMBLY

(76) Inventor: Allan E. Hopper, 333 Meadows Blvd., Unit #100, Mississauga, Ontario (CA) L4Z 1G9

( * ) Notice: Subject to any disclaimer, the term of this patent is extended or adjusted under 35 U.S.C. 154(b) by 0 days.

(21) Appl. No.: 12/179,938

(22) Filed: Jul. 25, 2008

(51) Int. Cl.
*B66C 23/44* (2006.01)

(52) U.S. Cl. ..... 212/180; 414/462

(58) Field of Classification Search ..... 212/180; 414/462

See application file for complete search history.

(56) References Cited

U.S. PATENT DOCUMENTS

| | | | | |
|---|---|---|---|---|
| 2,283,354 | A * | 5/1942 | Dalzell | 116/68 |
| 3,784,036 | A * | 1/1974 | Gjoerloff | 414/563 |
| 4,102,295 | A * | 7/1978 | Crook et al. | 116/281 |
| 4,419,038 | A | 12/1983 | Pendergraft | |
| 4,881,864 | A | 11/1989 | Amato | |
| 5,211,526 | A * | 5/1993 | Robinette | 414/550 |
| 5,281,078 | A * | 1/1994 | Mills, Jr. | 414/680 |
| 5,439,343 | A | 8/1995 | Watson | |
| 5,749,697 | A * | 5/1998 | Davis | 414/680 |
| 5,758,785 | A * | 6/1998 | Spinosa et al. | 212/300 |
| 5,993,137 | A | 11/1999 | Harr | |
| 6,386,820 | B1 * | 5/2002 | Cunningham | 414/550 |
| 6,499,610 | B2 | 12/2002 | Spitsbergen | |
| 6,821,075 | B2 | 11/2004 | Van der Horn | |
| 7,419,347 | B1 * | 9/2008 | Cormier | 414/462 |

OTHER PUBLICATIONS

Grablock, Inc., Website pages from www.grablock.com, Jul. 18, 2008.

* cited by examiner

*Primary Examiner*—Thomas J Brahan
(74) *Attorney, Agent, or Firm*—Daniel A. Thomson; Emerson, Thomson & Bennett, LLC

(57) ABSTRACT

There is provided a hoist assembly for attachment to a standard vehicle hitch. The assembly may be levelled horizontally and vertically to provide for safe operation of the hoist. The assembly includes a base member, supported by two vertically adjustable legs and a post attached at one end of the base. A boom is attached and coupled to the post with a ram which provides lift capabilities for the hoist. The base member may be rotated to adjust the vertical position of the post. A load indicator is provided to indicate a load exceeding the capacity of the hoist assembly.

20 Claims, 9 Drawing Sheets

HITCH MOUNTED HOIST ASSEMBLY

FIELD OF THE INVENTION

The present invention relates to a hoist assembly which may be mounted to a vehicle hitch attachment and used to assist with lifting items into or out of the vehicle.

BACKGROUND OF THE INVENTION

A hoist assembly for lifting a load or equipment into and out of a vehicle, such as a pickup truck, often is required since the load may not be lifted easily by hand. Rather than having separate hoist assemblies to load a vehicle and to unload the vehicle at its destination or at multiple destinations, it is convenient to have a hoist assembly which may be mounted to the vehicle and which may travel with the vehicle.

Various hoist or crane assemblies for use with a vehicle have been provided in the prior art. U.S. Pat. No. 4,419,038 to Pendergraft, issued Dec. 6, 1983, provides a hoist assembly which is integrated into a vehicle bumper. The assembly folds into the bumper and thus may be stored when not in use. However, the device of Pendergraft requires adaptation of the bumper and the vehicle itself in order to implement the hoist. U.S. Pat. No. 5,439,343 to Watson, issued Aug. 8, 1995, also provides a combined bumper and hoist assembly. U.S. Pat. No. 6,499,610 to Spitsbergen, issued Dec. 31, 2002, provides a compact hoist assembly which may be mounted via a base plate onto the cargo space of a vehicle, the flat bed of a truck or the roof of a building. U.S. Pat. No. 6,821,075 to van der Horn, issued Nov. 23, 2004, discloses a hoist adapted to fit with a standard vehicle receiver hitch with two structural supports extending from a boom support. While van der Horn notes the legs may be adjusted to account for use of a vehicle and the hitch assembly on uneven terrain, van der Horn does not provide a convenient and accurate means for positioning the hitch hoist. The support legs in the assembly disclosed by van der Horn may be adjusted but this would impact the leveling of the device both in the horizontal and vertical planes, making it difficult to provide a device which is both level and upright.

Other devices also have been provided such as the HITCH-HOIST™ product by Grablock Inc. This also provides a hoist assembly mounted to a vehicle hitch, however, leveling of the hoist assembly is provided in a single direction only. As well, the lift capacity of the hoist is limited by the rated tongue weight of the vehicle hitch.

Leveling of the hoist assembly in the horizontal plane and adjustment of the hoist assembly to a vertical position is desirable to ensure proper operation of the device, especially under heavy loads. Further, as a load is lifted using a hoist apparatus attached to a vehicle as described above, the back end of the vehicle may sink under the weight of the load, causing the hoist to become unleveled. An improperly leveled assembly may result in uneven distribution of the load, causing the load to swing or for the hoist to shift or topple, creating a safety concern. Improper leveling also can cause increased strain on the assembly and metal fatigue or failure. As well, it is desirable not to exceed the lift capacity of the hoist assembly as exceeding the maximum load capacity raises safety concerns and also may cause the load to swing or for the hoist to shift or topple.

Thus, it would be desirable to provide a hoist assembly which provides for lifting of various loads without modification to the vehicle itself or additional supports or devices to increase the lift capability of the vehicle. Further, it would be desirable to provide a hoist assembly that may be readily leveled horizontally and adjusted to a vertical position, and which indicates if the load capacity has been exceeded, in order to ensure safe and proper lifting of the load.

SUMMARY OF THE INVENTION

According to an embodiment of the present invention there is provided a hoist apparatus adapted for engagement with and support by a vehicle hitch attachment. The hoist apparatus comprises: an elongated base member for horizontal positioning, the base member having a first end and a second end; optionally two spaced ground engaging legs for supporting the base member, the legs secured to the base member adjacent the first and second ends, each leg being adjustable for horizontally levelling the base member; a post extending perpendicularly upwards from the base member, the post having first and second ends, the first end of the post adapted to be rotatably coupled to the first end of the base member and a boom, having a first end and a free end, the first end of the boom adapted to be mounted to the second end of the post, the free end of the boom having means for connecting a load. The hoist apparatus includes an elongated hitch mount member having a first insert end for mechanically engaging the vehicle hitch attachment and a second end, the second end of the hitch mount member adapted to rotatably engage a side portion of the base member. Hitch attachment means are provided and adapted to allow rotation of the base member relative to-the second end of the hitch mount member and to secure the base member to the hitch mount member in an adjustably fixed position to provide vertical positioning of the post. Lift means, adapted to be coupled with the post and the boom, are provided for raising or lowering the boom and the load relative to the base.

BRIEF DESCRIPTION OF THE DRAWINGS

These and other advantages of the invention will become apparent upon reading the following detailed description and upon referring to the drawings in which.

Figure 1:
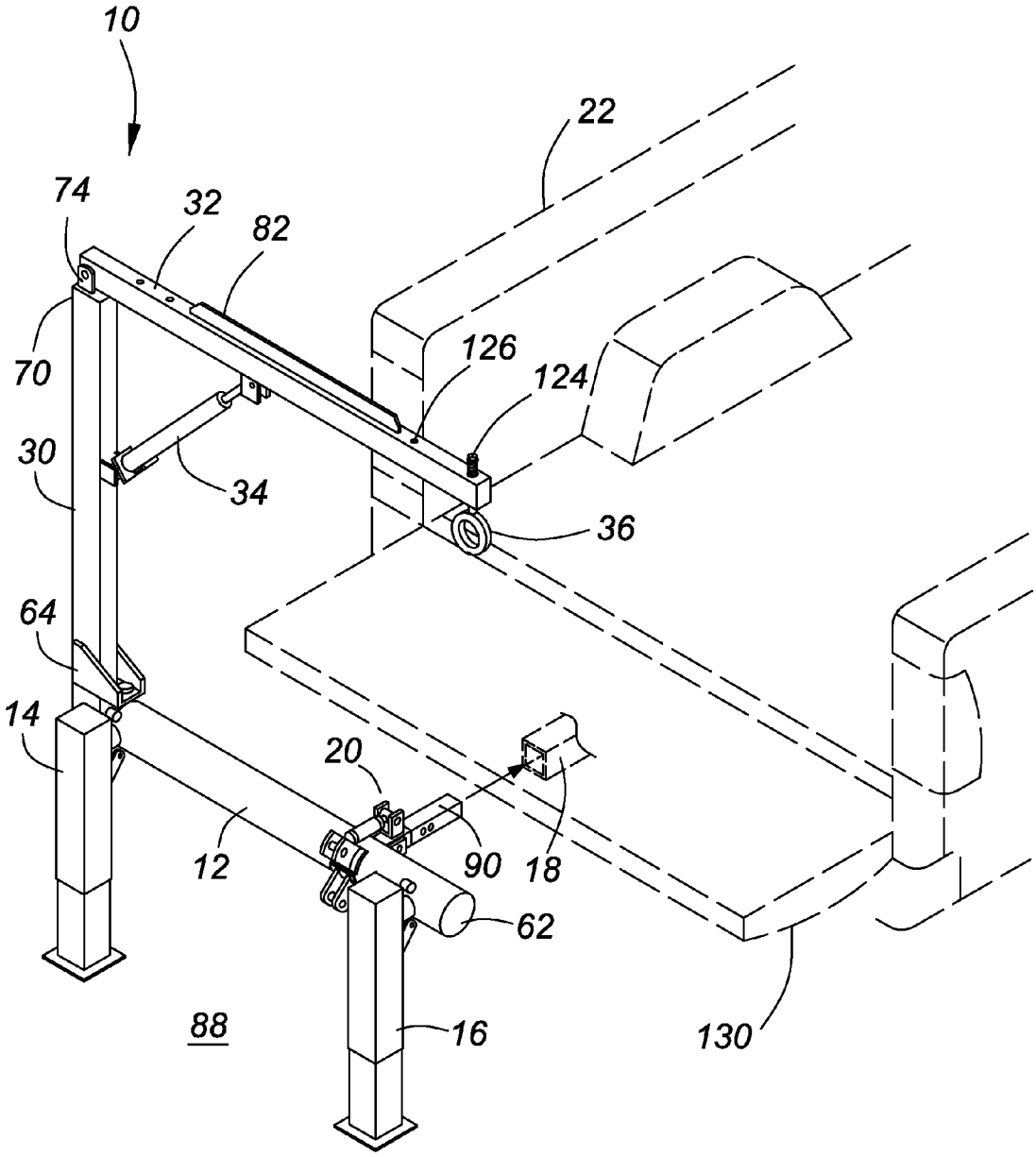
FIG. 1 is a front perspective view from above, of a hitch hoist assembly shown broken away from attachment to a vehicle, in accordance with the present invention.

While the invention will be described in conjunction with the illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION

In the following description, similar features in the drawings have been given identical reference numbers where appropriate.

Figure 1A:
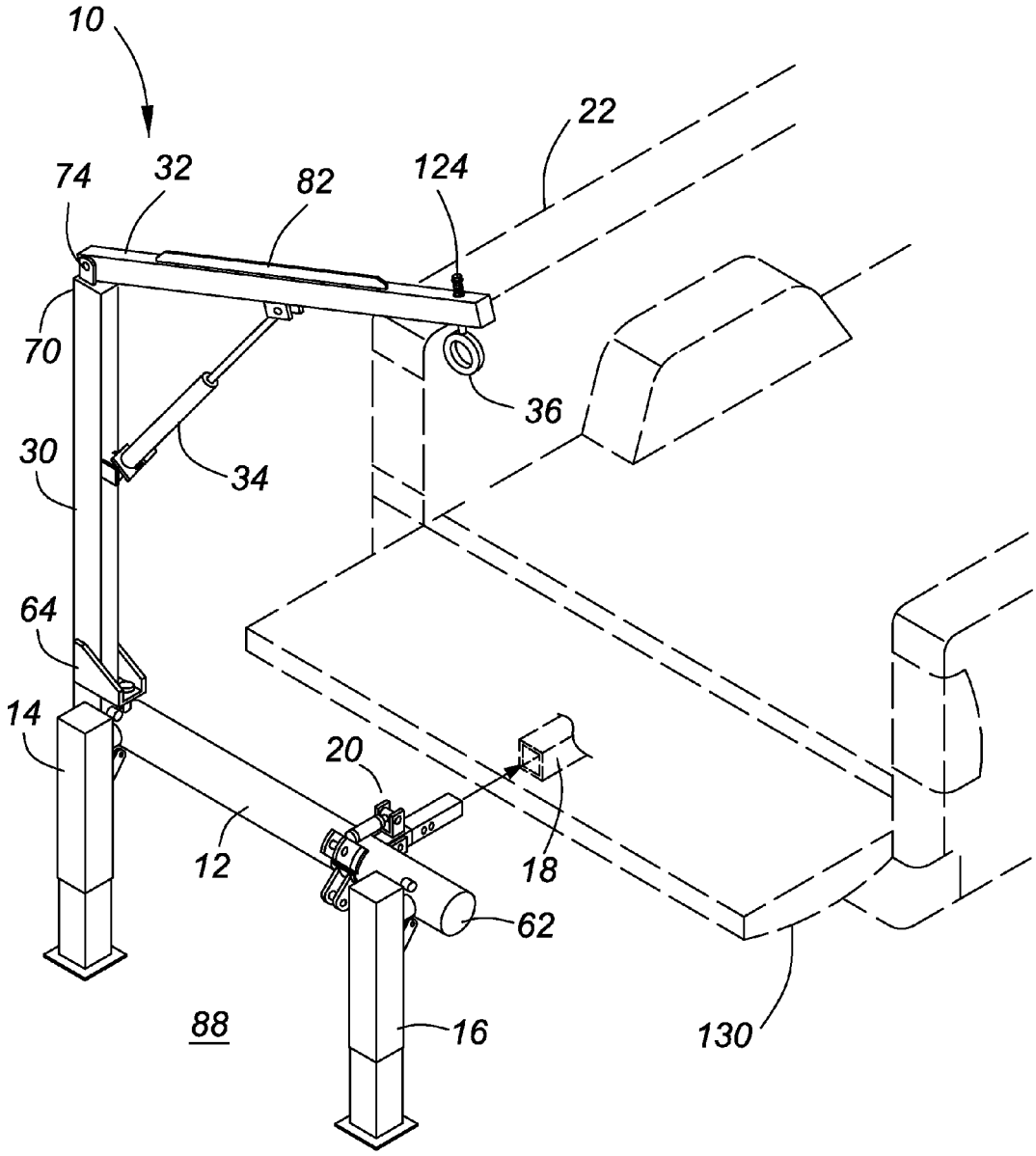
FIG. 1A is a front perspective view from above, of a hitch hoist assembly in accordance with the present invention, with the boom of the hoist assembly in a raised position.
Figure 2:
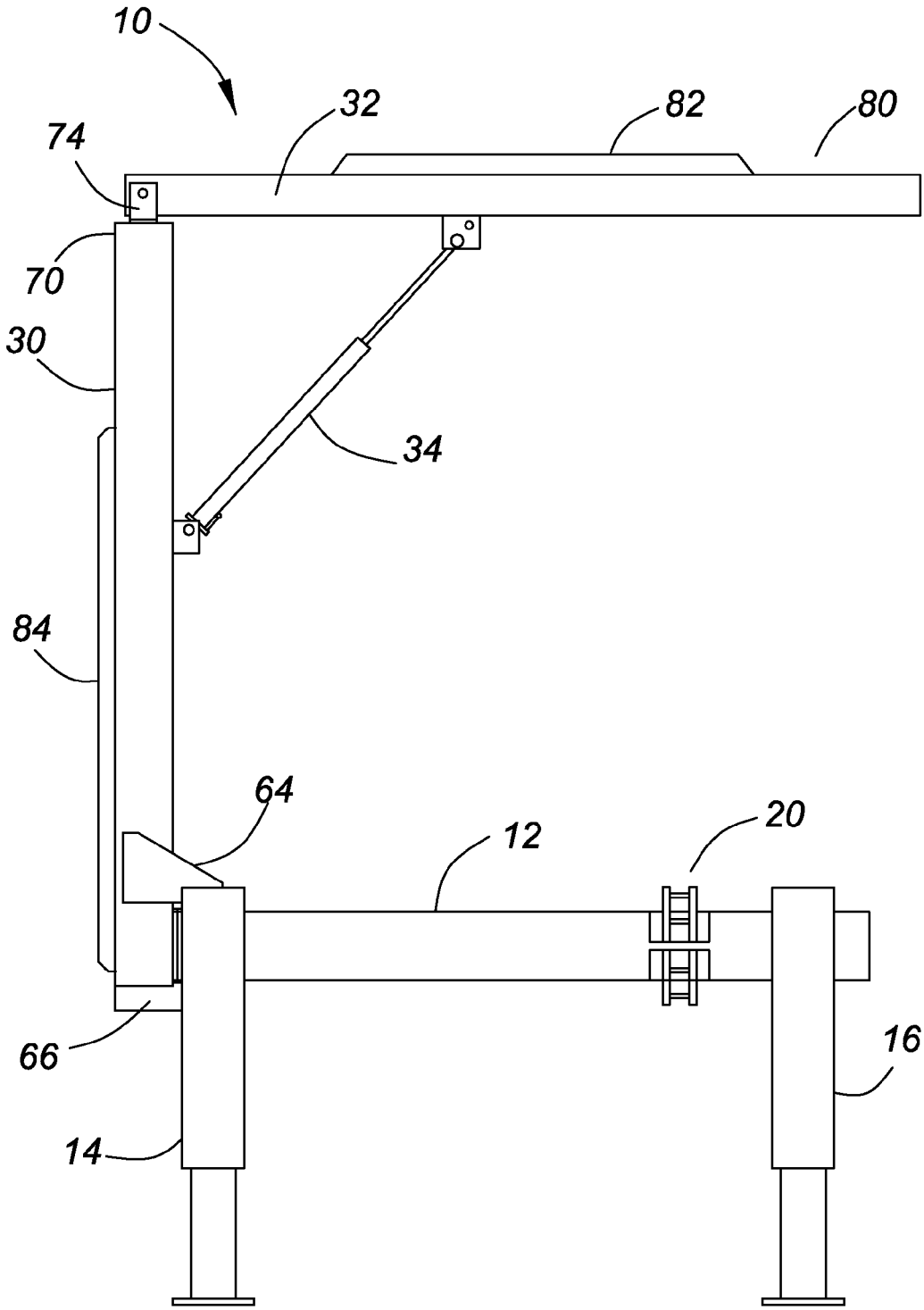
FIG. 2 is a front view of the hitch hoist assembly of FIG. 1.

Referring to the drawings and FIGS. 1, 1A and 2, there is shown a hitch hoist assembly 10 positioned or broken away from its attachment to a vehicle, the vehicle being shown in dashed lines. The hoist assembly 10 includes a base 12 and two support legs 14, 16. The base 12 may be affixed to a standard vehicle hitch receiver 18 via a hitch mount mechanism 20 for securing the hoist assembly 10 to the vehicle 22. The hoist assembly 10 further includes a post 30 affixed to the base 12 and a boom 32 which extends horizontally from the post 30. A ram 34 is located between the post 30 and boom 32. With the hoist assembly 10 affixed to the vehicle 22 via the hitch receiver 18 at the center of the vehicle 22, the base 12 and post 30 may be oriented to the left or to the right of the vehicle. In operation, as described below and as shown in FIG. 1A, the ram 34 may be extended to lift the boom 32 and a load (not shown) attached to the boom 32. The boom 32 includes attachment means 36 such as an eye, hook and/or a chain for attaching or supporting a load from the hoist assembly 10. The attachment means 36 also may function as an indicator of the weight of the load as described in further detail below. A winch (not shown) also may be attached to the boom 32 and used with the ram 34.

Figure 3:
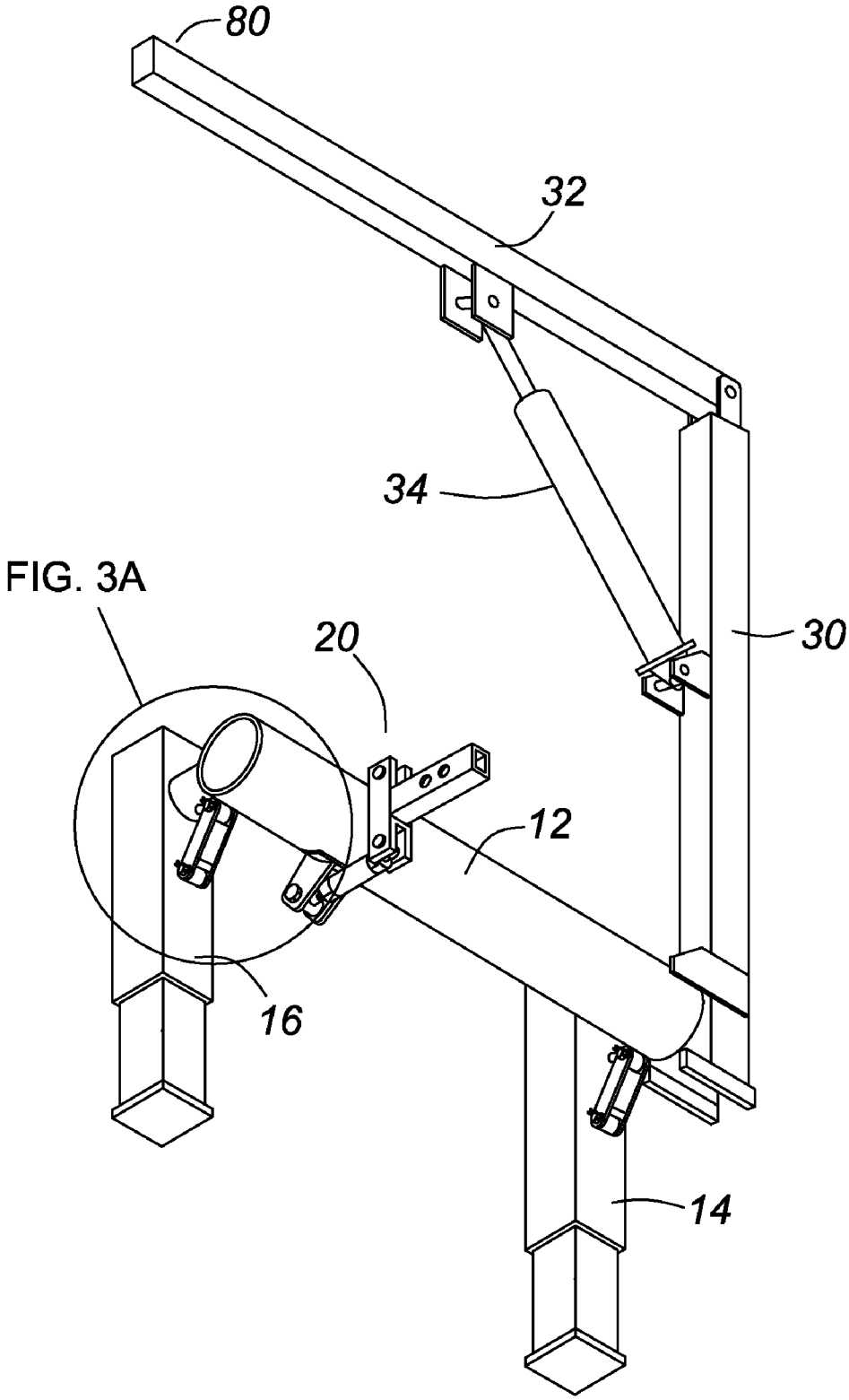
FIG. 3 is a rear perspective view from below, of the hitch hoist assembly of FIGS. 1 and 2.
Figure 3A:
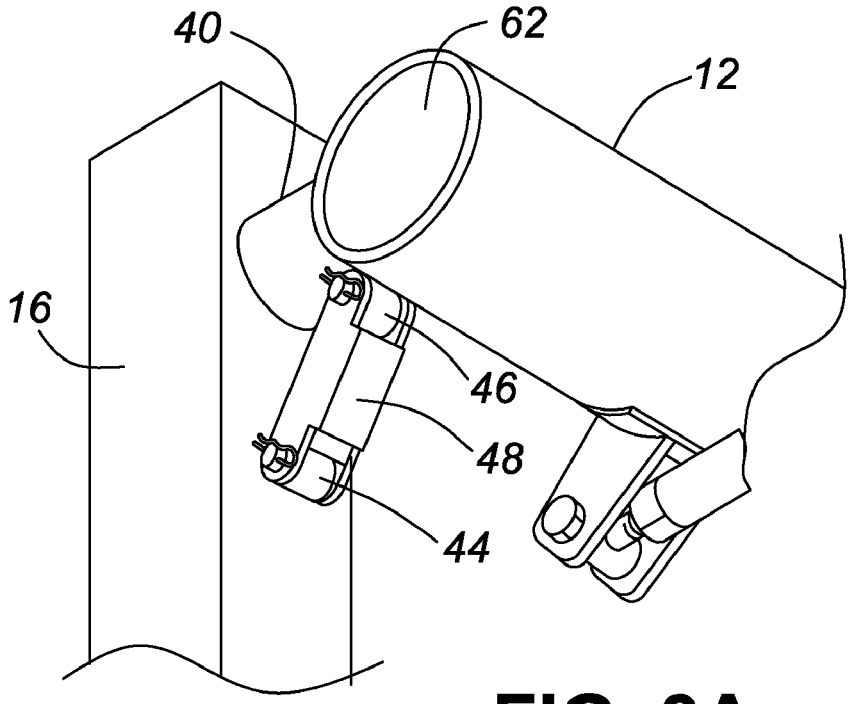
FIG. 3A is an enlarged partial view of a portion of the assembly of FIG. 3.
Figure 3B:
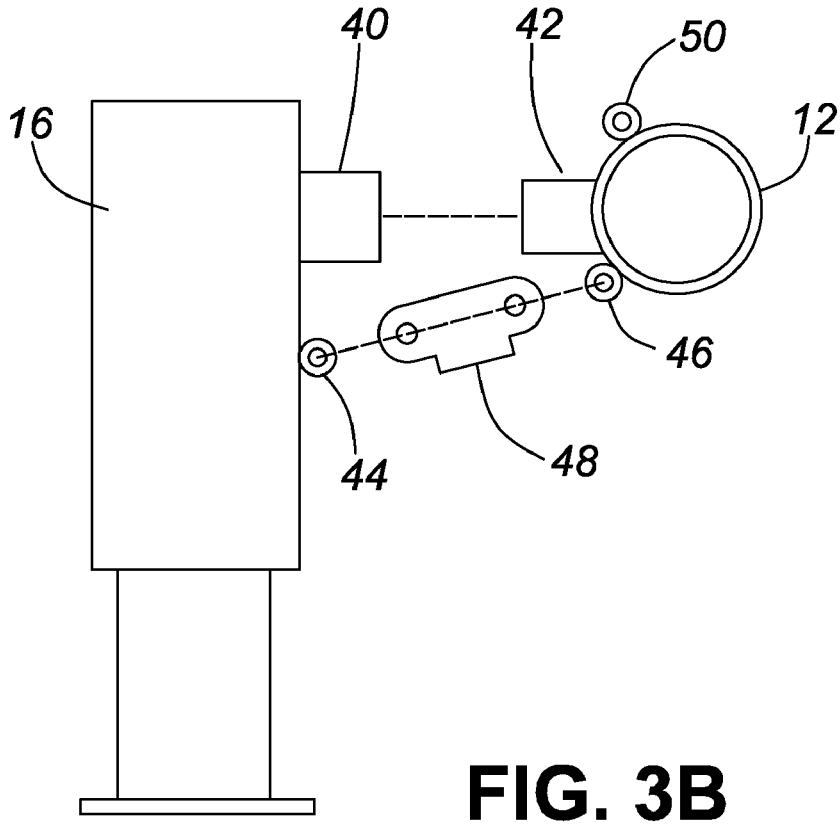
FIG. 3B is an exploded side view of the partial view of FIG. 3A.

FIGS. 3, 3A and 3B illustrate the connection of the legs 14, 16 to the base 12. Legs 14, 16 allow for vertical adjustment of the base 12. The legs 14, 16 may be formed from standard trailer jacks or foot jacks, such as a long neck (29 inch) 2000 lb, side-wind jack. To provide a hoist assembly 10 capable of lifting a load up to 750 lbs, trailer jacks having a maximum weight capacity of 2000 lbs or more are used for the legs 14, 16. As seen in FIGS. 3A and 3B, the leg 16 may be affixed to the side of the base 12 using a modified trailer jack connection. The leg 16 includes an outer sleeve 40, which corresponds to an inner sleeve 42 welded to the base 12. The inner sleeve 42 may be modified to accommodate a curved profile on the base 12. The leg 16 includes a tube 44 welded to the side of the leg 16 and the base 12 includes a similar tube 46. The base 12 and leg 16 may be connected by inserting the inner sleeve 42 of the base 12 into the outer sleeve 40 of the leg 16. By aligning the holes (not shown) in the sleeves 40, 42, the sleeves 40, 42 may be held together using standard pins and retainer clips (not shown). A locking arm 48 is connected to the tube 44 of the leg and the tube 46 of the base 12, using standard pins and retainer clips (not shown) providing additional support for the base 12 and ensuring a perpendicular connection between the base 12 and the leg 16. Bolted connections also may be provided for the locking arm 48 and tubes 44, 46. A second tube 50 may be provided on the base 12 to provide a similar connection for the locking arm 48 when the hoist assembly 10 is flipped and mounted with the post 30 positioned on the passenger side of the vehicle 22.

As shown in FIGS. 3, 3A and 3B, the leg 16 may be connected in an upright position. When not in use, the hoist assembly 10 may be configured to a position for traveling with the vehicle. By removing the pins and retainer clips connecting the sleeves 40, 42 and removing the locking arm 48, the leg 16 may be rotated to a position parallel and adjacent to the base 12. A second set of holes in the sleeves 40, 42 may be aligned and the sleeves 40, 42 secured in this alternate position to allow the leg 16 to be kept clear from the ground. Thus, the hoist assembly 10 may remain mounted to the vehicle 22 while the vehicle 22 is in motion and the legs 14, 16 quickly repositioned in the vertical orientation to allow setup and use of the hoist assembly 10. Although not shown in detail in the Figures, a similar connection and locking arm 48 is provided for the leg 14 and base 12.

Legs 14, 16 are secured to the base and each may be vertically adjusted, for example by standard adjustment of the trailer jack, to permit leveling of the base 12 along its longitudinal axis. Where a vehicle 22 and the hoist assembly 10 are positioned on uneven terrain, vertical adjustment of the legs 14, 16 provides for horizontal adjustment and support of the base 12. Although the amount of leveling of the base 12 is limited by the connection of the hoist assembly 10 to the square hitch receiver 18 on the vehicle 22, as described below, leveling of the base 12 by a small amount to accommodate even slightly uneven terrain improves the operation of the hoist assembly 10. An indicator such as a bubble level (not shown) may be provided on the base 12 to indicate proper leveling of the base 12 along its horizontal or longitudinal axis.

Figure 4:
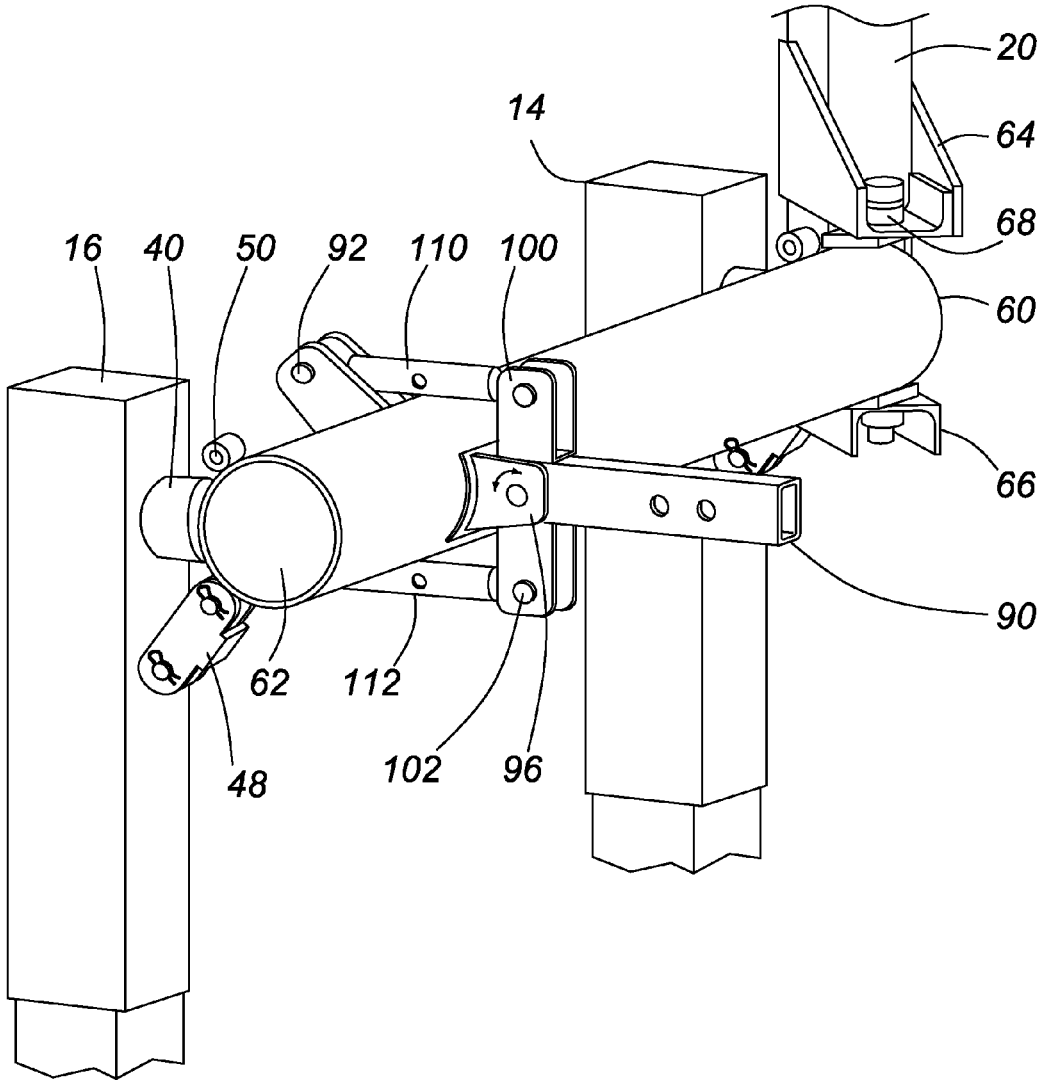
FIG. 4 is a partial view of the hitch hoist assembly of the preceding Figures.

As illustrated in FIGS. 2 and 4, the post 30 is attached at its lower end to the end 60 of base 12 in a manner that allows the post 30 to pivot or rotate with respect to the end 60. More particularly, the post 30 is secured to the end 60 of base 12 via mounting plates 64 and 66 secured to the post 30. The plates 64 and 66 are fastened by a bolt 68 through the end 60 of the base 12 so that bolt 68 becomes the pivot point for the post 30. The post 30 may be connected to the base 12 in other ways to allow for rotation of the post.

The boom 32 may be attached to the end 70 of the post 30 via mounting plates 74 and 76 affixed to the end 70 of the post 30. As illustrated, the boom 32 may be bolted between the plates 74 and 76, allowing the boom 32 to pivot about the end 70 of the post 30, thereby allowing the free end 80 of the boom 32 to be raised. Alternatively, plates (not shown) could be provided on the boom 32 and bolted through the post 30. A reinforcing spine or gusset 82 provides added strength to the boom 32 against the bending forces on the boom 32 when lifting a load. A reinforcing gusset 84 also may be provided on the post 30. The base 12, post 30 and boom 32 may be made of low carbon steel or any other suitable material.

As shown in FIGS. 1 to 3, a ram 34, such as a hydraulic ram, may be located between the post 30 and boom 32. The ram 34 may be a standard hydraulic ram jack which, when operated by a user, extends and forces the boom 32 to pivot upwards about the end 70 of the post 30, as shown in FIG. 1A, thereby lifting a load (not shown) attached to the boom 32. To provide lift capabilities of up to 750 lbs, the ram 34 may be a common 3 ton jack. As the ram 34 is extended and the load is lifted by the hitch hoist assembly 10, the post 30 may be rotated about the base 12, permitting the load to be lifted off of a vehicle 22, carried outward or forward across the base 12 and then lowered to the ground 88 in front of the hitch hoist assembly 10.

It will be understood that other means of attaching the post 30, base 12, and boom 32 could be implemented to lift, support and rotate a load. As well, lift means other than a hydraulic ram 34 could be provided, such as a cable winch, in order to raise and lower a load attached to a hoist assembly 10. Similarly, lift means could be provided to lift and lower the entire boom 32, or extend or raise the post 30, thus lifting and lowering the boom 32 and any attached load.

Figure 5:
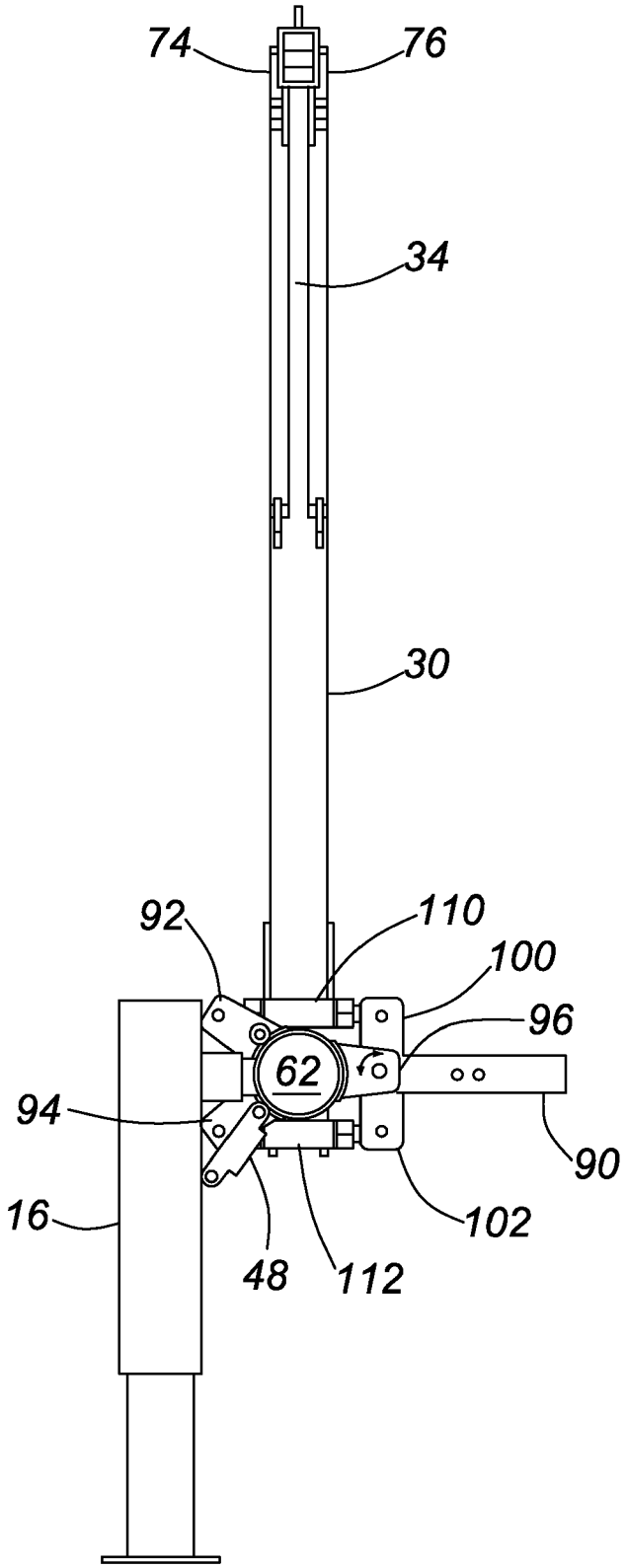
FIG. 5 is a side view of the hitch hoist assembly of the preceding Figures.
Figure 6A:
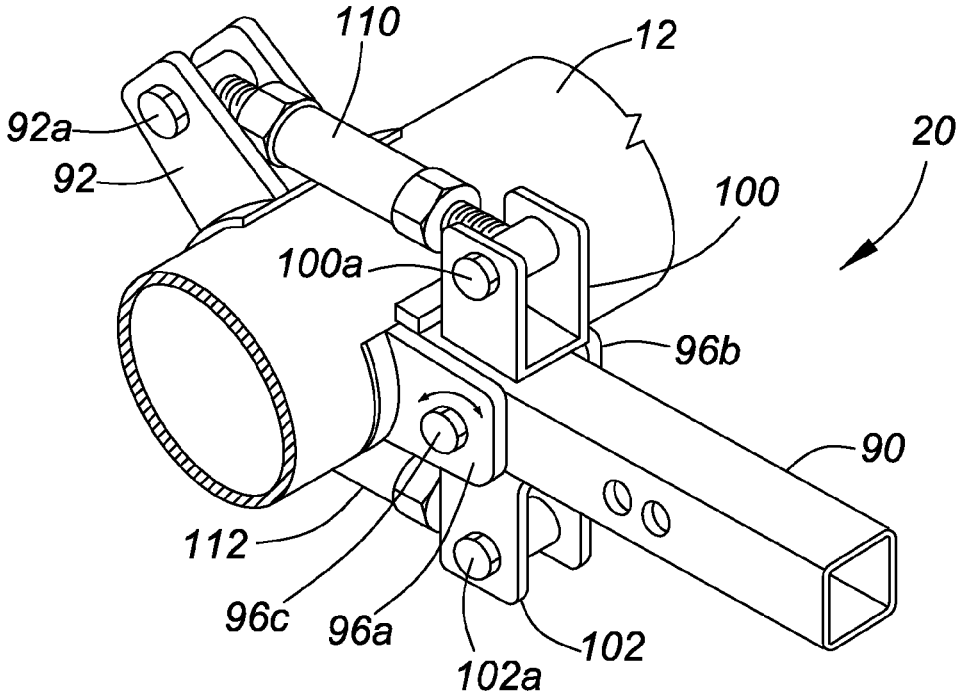
FIGS. 6A and 6B are enlarged partial perspective views of the hitch mount mechanism at the base of the hitch hoist assembly of the preceding Figures.
Figure 6B:
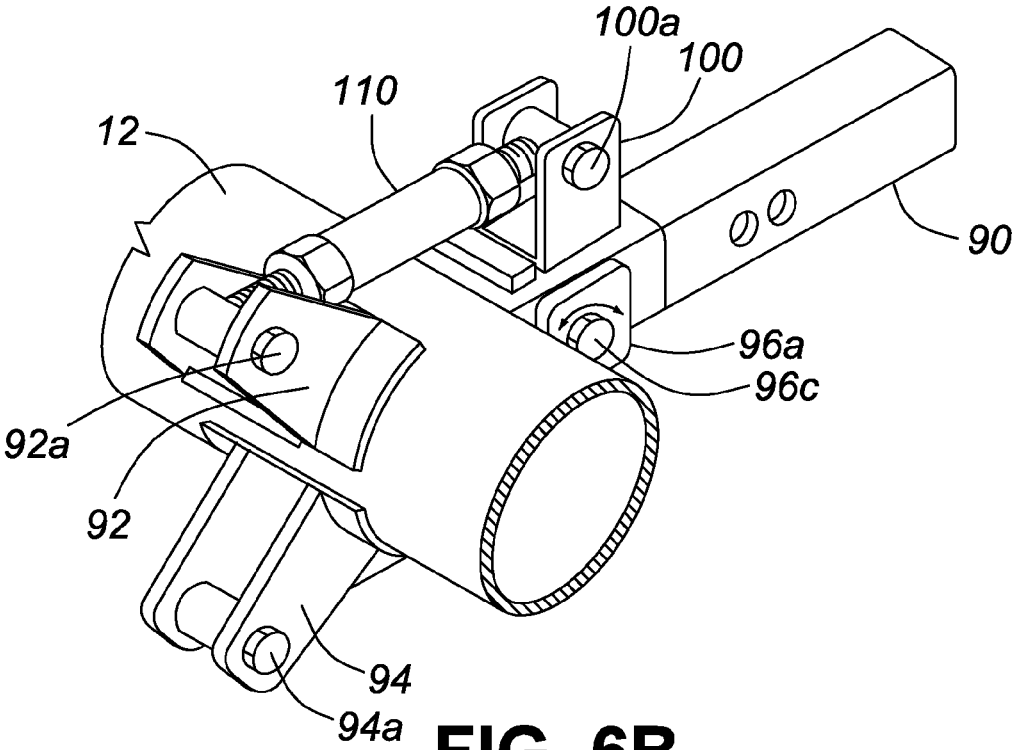

FIG. 5 provides a side view of the hoist assembly 10 showing the hitch mount mechanism 20. The hitch mount mechanism 20 is shown in greater detail in FIGS. 6A and 6B. The hitch mount mechanism 20 includes a tongue 90 for insertion into a standard vehicle hitch receiver 18 and base member brackets 92, 94 and 96 positioned around the base 12. The base 12 is secured to the hitch mount mechanism 20 by means which permit the adjustment of the base 12 to ensure the post 30 is set in a vertical position. As shown in FIGS. 5, 6A and 6B, base member brackets 92, 94 and 96 are spaced apart and welded to the base 12. Corresponding hitch mount brackets 100, 102 are attached to the tongue 90 for connecting to the base member brackets 92, 94 and securing the base 12. Base member bracket 96 is affixed to the tongue 90 using plates 96*a* and 96*b* and a pin or bolt 96*c* inserted through the plates 96*a* and 96*b* and tongue 90. Thus, the base 12 may rotate about the axis created by the bolt 96*c*, as indicated by the arrow in FIGS. 6A and 6B. Thus the base 12 may be rotated relative to the hitch mount mechanism 20.

A mechanism such as a turnbuckle 110 may be provided on the upper side of the base 12 to connect the upper base member bracket 92 with the hitch mount bracket 100. A second similar mechanism, such as lower turnbuckle 112, connects the lower base member bracket 94 with the hitch mount bracket 102. The turnbuckles 110, 112 may be held in place in the brackets 92, 94, 100 and 102 using pins and retaining clips (not shown). Preferably, the turnbuckles 110, 112 may be held in place using bolts 92*a*, 94*a*, 100*a* and 102*a* and nuts to provide a stable connection. In one embodiment, the upper and lower base member brackets 92 and 94 may be positioned on the base member 12 approximately 80 degrees apart; each base member bracket 92 and 94 being positioned approximately 140 degrees from the base member bracket 96.

As can be appreciated from FIGS. 6A and 6B, with the lower turnbuckle 112 disconnected, adjusting the upper turnbuckle 110 draws or spreads the upper base member bracket 92 and hitch mount bracket 100 closer together or further apart, thus rotating the base 12 in either a clockwise or a counter clockwise direction about the bolt 96*c*. Once the base 12 and upper turnbuckle 110 are positioned, as described below, re-attaching and tightening of the lower turnbuckle 112 removes any mechanical slack so as to keep the base 12 static. In this manner, the base 12 may be adjusted and rotated such that the post 30, attached at one end of the base 12, is adjusted and set in a vertical position. An indicator such as a bubble level (not shown) may be provided on the post 30 and on the base 12 to indicate vertical positioning of the post 30 and thus proper positioning of the base 12. Tightening of the lower turnbuckles 112 then secures the base 12 in a fixed position relative to the hitch mount mechanism 20 and the vehicle 22.

Figure 7A:
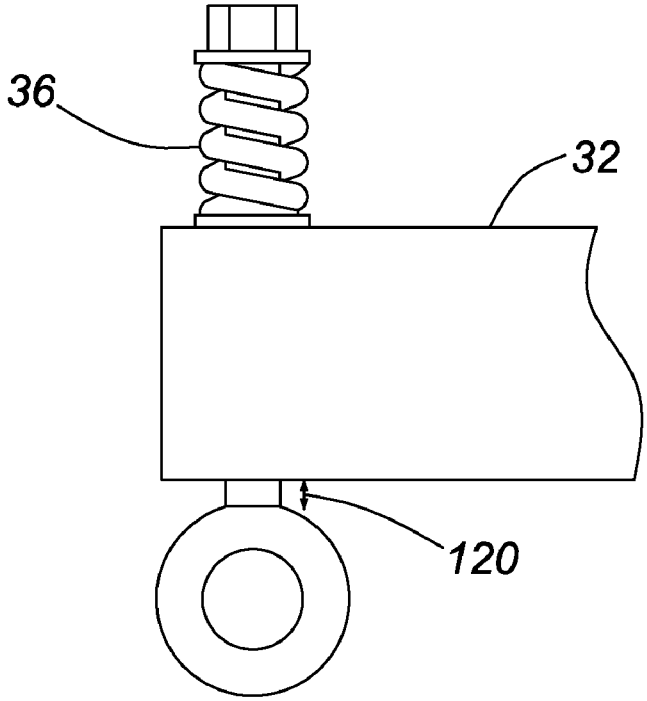
FIGS. 7A and 7B are close-up, cut-away views of a load gauge mechanism for the assembly of the preceding Figures.
Figure 7B:
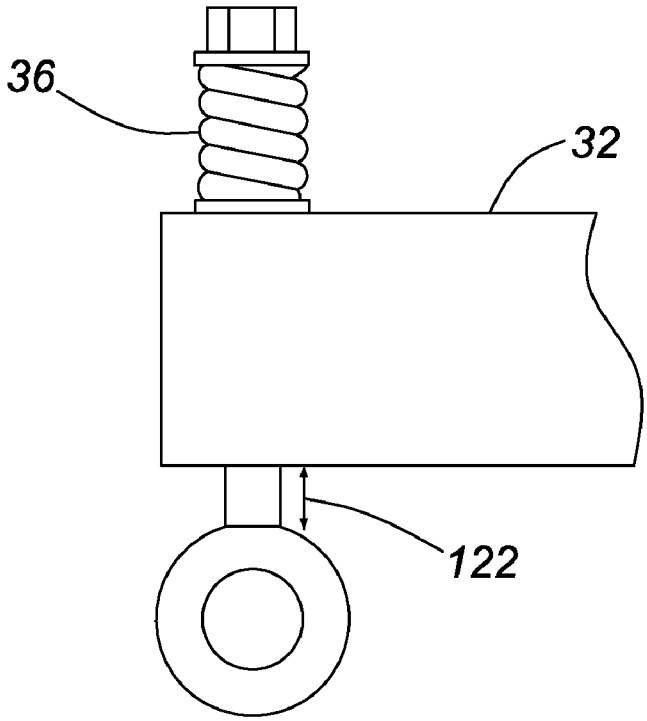

FIGS. 7A and 7B provide a front view of an attachment means and load indicator 36 which may be attached to the boom 32. The load indicator 36 provides an attachment point for a load (not shown) and indicates whether the load and associated rigging, chains or attachments (not shown) exceeds the lift capability of the device. In one embodiment, the load indicator 36 may be a precision die spring configured to compress a predetermined amount at the rated maximum load, such as 750 lbs. For example, a heavy duty precision die spring that is 2 inches long with a 1.25 inch outside diameter and ⅝ inch inside hole may be used. Maximum load deflection is 30 percent at 897.6 lbs and the die spring has an efficient operating range of 15% to 20% deflection. In FIG. 7A, under a no-load or minimal load condition, the load indicator 36 extends a minimal distance as shown by the arrow 120 below the boom 32. In FIG. 7B, under a maximum load condition, the load indicator 36 extends a distance 122 further below the boom 32. Although not shown in FIGS. 7A and 7B, a visual indication may be provided on the load indicator 36 so that as the maximum load or maximum distance as shown by the arrow 122 is reached, a line or change in colour on the load indicator 36 provides a visual warning that the maximum load capacity for the hoist assembly 10 has been reached.

In operation, the base 12 and hitch mount mechanism 20 of the hoist assembly 10 may be affixed to a vehicle 22 by inserting the tongue 90 of the hitch mount mechanism 20 into a standard 2" square vehicle hitch receiver 18. The tongue 90 may be secured to the hitch receiver with standard pins and clips. Next, the post 30 is attached to one end 60 of the base 12 and the legs 14, 16 are attached to the base 12 as described above, on a side opposite the tongue 90, with one leg 14, 16 supporting each end 60, 62 of the base 12. The legs 14, 16 are adjusted or shortened so as not to engage the ground 88 at this point.

The base 12 and post 30 are first leveled by adjusting turnbuckles 110, 112. The lower turnbuckle 112 is detached at one end by removing the bolt 94*a* from the bracket 94. The upper turnbuckle 110 is adjusted to set the post 30 in a vertical position. The legs 14, 16 are then extended until the hoist assembly 10 engages the ground 88. The legs 14, 16 may be adjusted to level the base 12 about its longitudinal axis. Adjustment of the legs 14, 16 serves to level the base 12 and lift the back end of the vehicle 22 slightly. This pre-stresses the hoist assembly 10, thus solidifying the base 12 and providing counter weight to the hoist assembly 10 during operation. Thus, during use, as the post 30 is rotated and the load is transitioning from outboard or inboard the vehicle 22, unwanted movement or shifting of the hoist assembly 10 and load are limited.

After adjusting the legs 14, 16, the post 30 may require further adjustment and re-positioning vertically via adjustment of the base 12 and turnbuckles 110, 112 as described above. As a test, the post 30 may be rotated to ensure the hoist assembly 10 remains level on both a horizontal and vertical axis. Finally, the lower turnbuckle 112 is re-attached by replacing the bolt 94*a* in the bracket 94 and tightening the lower turnbuckle 112 so that the base 12 is firmly secured to the hitch mount mechanism 20. It will be appreciated that the above assembly and leveling procedure also may be completed by first disconnecting the upper turnbuckle 110, adjusting the lower turnbuckle 112 and then reconnecting and tightening the upper turnbuckle 110.

The setup of the hoist assembly 10 is completed by affixing the ram 34 to the post 30 and boom 32, and affixing a load (not shown) to the boom 32 via chains or rigging (not shown). As described above, the load may be affixed to the boom 32 via a load indicator 36. By operating and extending the ram 34 in a known fashion, as shown in FIG. 1A, the free end 80 of the boom 32 may be extended upward to lift the load above, for example, the level of a truck bed. The load may be positioned over the truck bed by manually rotating the post 30. The ram 34 may be released to then lower the load onto the truck or vehicle 22. The legs 14, 16 may be reconfigured on the hitch assembly 10 as described above, allowing the hitch assembly 10 to remain mounted to the vehicle while the vehicle is in motion. The legs 14, 16 may be reconfigured back again and the device 10 leveled as described above for operation at a second or remote site.

The hoist assembly 10, when affixed to a standard class III or higher V5 rated 2" square vehicle hitch receiver 18 may support a load of up to 750 lbs, inclusive of any chains or rigging associated with the load without requiring modification to the vehicle. Lower rated hitches may be used which would provide a reduced lift capability.

In one embodiment, with a boom 32 approximately 57 inches long, a post 30 approximately 56 inches long and a base 12 approximately 45 inches long, a 750 lb load may be supported at a first position 124 on the boom, approximately an inch from the free end 80 of the boom 32 or at a second position 126 approximately ten inches from the free end 80 of the boom 32, as indicated in FIG. 1. The ram 34 is connected to the boom 32 at a point approximately 33 inches from the free end 80 of the boom 32 and to the post 30 approximately 35 inches from the top end 70 of the post 30. In this embodiment, the hoist assembly 10 has a maximum height reach of 10 feet and the free end 80 of the boom 32 may be elevated up to 5 feet. As can be appreciated by those skilled in the art, by varying the dimensions of the boom 32, post 30 and base 12, as well as the attachment points of the ram 34 and the load, heavier loads could be supported.

The hitch mount mechanism 20 typically is affixed to the base 12 approximately 32 to 36 inches from the post 30, allowing for a standard truck gate 130 to be lowered over the base 12 without interfering with the hoist assembly 10. The base 12 typically is rotated 5 to 10 degrees to ensure a vertical positioning of the post 30, although the base 12 may be rotated up to 30 degrees. The post 30 may rotate 90 degrees about the base 12 to provide for removal and placement of a load from or into a vehicle. The hoist assembly 10 is shown in FIG. 1 extending to the left or driver's side of the vehicle, but it can be appreciated that the device may be assembled to locate the post 30 adjacent the right or passenger side of the vehicle.

Thus, it is apparent there has been provided in accordance with the embodiments of the present invention a hoist assembly that fully satisfies the objects, aims and advantages set forth above. While the invention has been described in conjunction with the illustrated embodiments thereof, it is evident that many alternatives, modifications and variations thereof will be apparent to those skilled in the art in light of the foregoing description. Accordingly, it is intended to embrace all such alternatives, modifications and variations as fall within the spirit and broad scope of the invention.

What is claimed is:

1. A load hoist apparatus for mounting to a vehicle hitch comprising:

a base member having an elongate axis;

at least one ground-contacting legs secured to the base member;

a post mounted to the base member for extending upwardly from the base member when supporting an associated load;

a boom extending from the post, the boom for hoisting an associated load;

a hitch mount member for engaging the vehicle hitch, the hitch mount member having an elongate axis;

a rotary coupling configured to attach the base member to the hitch mount member in an orientation wherein the respective elongate axes thereof are perpendicular, the rotary coupling to allow rotation of the base member relative to the hitch mount member about a tilt adjustment axis parallel to the elongate axis of the base member, wherein rotation about the tilt adjustment axis provides fore and aft tilting of the post; and a continuously adjustable member associated with the rotary coupling to fix the base member in a selected radial position about the tilt adjustment axis for maintaining the post in a selected upright position.

2. The hoist apparatus of claim 1 wherein the at least one ground-contacting leg is longitudinally adjustable.

3. The hoist apparatus of claim 1 wherein at least one of the actuators comprises a turnbuckle.

4. The hoist apparatus of claim 1 wherein two of the legs are located adjacent to opposing ends of the base member.

5. The hoist apparatus of claim 1 wherein the boom is pivotably mounted on the post.

6. The hoist apparatus of claim 5 further comprising a hydraulic ram coupled to the post and the boom, wherein extension of the hydraulic ram causes the free end of the boom to pivot upwardly.

7. The hoist apparatus of claim 1 further comprising a first reaction arm projecting radially from said base member; and said continuously adjustable member comprises an actuator having a first end engaged to said hitch mount member and a second end engaged to said first reaction arm wherein extending said actuator causes rotation of said base member in a first direction about said tilt adjustment axis and retracting said actuator causes rotation of said base member in an opposed direction about said tilt adjustment axis.

8. The hoist apparatus of claim 7 further comprising a second reaction arm projecting radially from said base member at a location radially displaced from said first reaction arm, and further comprising a second actuator having a first end engaged to said hitch mount member and a second end attached to said second reaction arm, wherein said first and second actuators are configured to rotate said base member in said first or second direction by the mutually cooperating extension and retraction of said actuators.

9. The hoist apparatus of claim 8 wherein at least one of said actuators comprises a turnbuckle.

10. The hoist apparatus of claim 1 further comprising an arm projecting radially from said base member, and said rotary coupling comprises a pivot mount configured to rotatably engage said arm at an axis of rotation radially displaced from the elongate axis of said base member.

11. The hoist apparatus of claim 1 wherein said post is rotatably mounted to said base member.

12. A mount for attaching a hoist to a vehicle hitch, said hoist comprising a base member having an elongate axis and a post and boom arrangement extending upwardly from said base member for hoisting a load, said mount comprising:

a hitch mount member having a first end for rigid mounting to said vehicle hitch, said hitch mount member having an elongate axis;

a rotary coupling at a second end of said hitch mount member, for engaging said base member in an orientation wherein the respective axes of the hitch mount member and base member are perpendicular, said rotary coupling to permit rotation of said base member about a tilt adjustment axis displaced from and parallel to the elongate axis of said base member, and rotation of said base member causes tilting of said post in a fore or aft direction;

a first reaction arm for attachment to said base member to project radially therefrom; and, an actuator having a first end engaged to said hitch mount member and a second end engaged to said first reaction arm wherein extending said actuator causes rotation of said base member in a first direction about said tilt adjustment axis and retracting said actuator causes rotation of said base member in an opposed direction about said tilt adjustment axis.

13. A mount as defined in claim 12 further comprising a second reaction arm for attachment to said base member at a location radially displaced from said first reaction arm to project radially from said base member, and further comprising a second actuator having a first end engaged to said hitch mount member and a second end engaged to said second reaction arm, wherein said first and second actuators are configured to rotate said base member in said first or second direction about said tilt adjustment axis by the mutually cooperating extension and retraction of said actuators.

14. A mount as defined in claim 13 wherein at least one of said actuators comprises a turnbuckle.

15. A mount as define in claim 12 wherein said rotary coupling comprises a pivot mount configured to rotatably engage an arm projecting radially from said base member, defining an axis of rotation radially displaced from the elongate axis of said base member.

16. A load hoist apparatus for mounting to a vehicle hitch, comprising:

a base member having an elongate axis;

a post mounted to said base member for extending upwardly from said base member when supporting a load;

a boom extending from said post, said boom for hoisting a load;

a hitch mount member for engaging the vehicle hitch, said hitch mount member having an elongate axis;

a rotary coupling configured to attach said base member to said hitch mount member in an orientation wherein the respective elongate axes thereof are perpendicular, said rotary coupling to allow rotation of the base member relative to the hitch mount member about a tilt adjustment axis parallel to the elongate axis of the base member wherein rotation about said tilt adjustment axis provides fore and aft tilting of the post; and a continuously adjustable member associated with said rotary coupling to fix said base member in a selected radial position about said tilt adjustment axis for fixedly holding said post in a selected upright position.

17. The hoist apparatus of claim 16 further comprising a first reaction arm projecting radially from said base member; and said continuously adjustable member comprises an actuator having a first end engaged to said hitch mount member and a second end engaged to said first reaction arm wherein extending said actuator causes rotation of said base member in a first direction about said tilt adjustment axis and retracting said actuator causes rotation of said base member in an opposed direction about said tilt adjustment axis.

18. The hoist apparatus of claim 17 further comprising a second reaction arm projecting radially from said base member at a location radially displaced from said first reaction arm, and further comprising a second actuator having a first end engaged to said hitch mount member and a second end attached to said second reaction arm, wherein said first and second actuators are configured to rotate said base member in said first or second direction by the mutually cooperating extension and retraction of said actuators.

19. The hoist apparatus of claim 18 wherein at least one of said actuators comprises a turnbuckle.

20. The hoist apparatus of claim 16 further comprising an arm projecting radially from said base member, and said rotary coupling comprises a pivot mount configured to rotatably engage said arm at a location radially displaced from the elongate axis of said base member.

* * * * *